US006781548B2

(12) United States Patent
Wen et al.

(10) Patent No.: US 6,781,548 B2
(45) Date of Patent: Aug. 24, 2004

(54) ELECTRICALLY CONNECTED MULTI-FEED ANTENNA SYSTEM

(75) Inventors: Geyi Wen, Waterloo (CA); Yihong Qi, Waterloo (CA); Perry Jarmuszewski, Guelph (CA)

(73) Assignee: Research In Motion Limited, Waterloo (CA)

( * ) Notice: Subject to any disclaimer, the term of this patent is extended or adjusted under 35 U.S.C. 154(b) by 310 days.

(21) Appl. No.: 10/014,940

(22) Filed: Oct. 26, 2001

(65) Prior Publication Data

US 2002/0044093 A1 Apr. 18, 2002

Related U.S. Application Data

(63) Continuation of application No. 09/543,176, filed on Apr. 5, 2000, now Pat. No. 6,329,951.

(51) Int. Cl.[7] ..... H01Q 1/24
(52) U.S. Cl. ..... 343/702; 343/700 MS
(58) Field of Search ..... 343/727, 818, 343/702, 700 MS

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,376 | A | 8/1972 | Pronovost |
| 4,024,542 | A | 5/1977 | Ikawa et al. |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |
| 4,590,614 | A | 5/1986 | Erat |
| 4,730,195 | A | 3/1988 | Phillips et al. |
| 4,839,660 | A | 6/1989 | Hadzoglou |
| 4,847,629 | A | 7/1989 | Shimazaki |
| 4,857,939 | A | 8/1989 | Shimazaki |
| 4,890,114 | A | 12/1989 | Egashira |
| 4,894,663 | A | 1/1990 | Urbish et al. |
| 4,975,711 | A | 12/1990 | Lee |
| 5,030,963 | A | 7/1991 | Tadama |
| 5,138,328 | A | 8/1992 | Zibrik et al. |
| 5,214,434 | A | 5/1993 | Hsu |
| 5,218,370 | A | 6/1993 | Blaese |
| 5,227,804 | A | 7/1993 | Oda |
| 5,245,350 | A | 9/1993 | Sroka |

(List continued on next page.)

FOREIGN PATENT DOCUMENTS

| | | |
|---|---|---|
| EP | 0543645 | 5/1993 |
| EP | 0571124 | 11/1993 |
| EP | 0765001 | 3/1997 |
| EP | 0814536 | 12/1997 |
| EP | 0892459 | 1/1999 |
| GB | 2330951 | 5/1999 |
| JP | 55147806 | 11/1980 |
| JP | 05007109 | 1/1993 |
| JP | 5129816 | 5/1993 |
| JP | 5267916 | 10/1993 |

(List continued on next page.)

OTHER PUBLICATIONS

PCT International Search Report (Int'l Appln. No. PCT/CA01/00416 filed Mar. 29, 2001).

Microwave Journal, May 1984, p. 242, advertisement of Solitron/Microwave, XP002032716.

*Primary Examiner*—James Vannucci
(74) *Attorney, Agent, or Firm*—Jones Day; Krishna K. Pathiyal; Charles B. Meyer

(57) ABSTRACT

An antenna system for a portable transceiver device comprises an antenna structure for transmitting and receiving RF signals. The antenna structure includes multiple feeding ports having a common structure fully coupling multiple antennas together. This antenna structure is made of a conductor that can be surface mounted over a nonplanar surface. When the conductor is mounted on a nonplanar surface, the antenna structure extends in three dimensional space around the portable communications device.

15 Claims, 2 Drawing Sheets

U.S. PATENT DOCUMENTS

| | | | | | |
|---|---|---|---|---|---|
| 5,257,032 | A | | 10/1993 | Diamond et al. | |
| 5,347,291 | A | | 9/1994 | Moore | |
| 5,373,300 | A | | 12/1994 | Jenness et al. | |
| 5,422,651 | A | | 6/1995 | Chang | |
| 5,451,965 | A | | 9/1995 | Matsumoto | |
| 5,451,968 | A | | 9/1995 | Emery | |
| 5,457,469 | A | | 10/1995 | Diamond et al. | |
| 5,489,914 | A | * | 2/1996 | Breed | 343/818 |
| 5,493,702 | A | | 2/1996 | Crowley et al. | |
| 5,684,672 | A | | 11/1997 | Karidis et al. | |
| 5,767,811 | A | | 6/1998 | Mandai et al. | |
| 5,821,907 | A | | 10/1998 | Zhu et al. | |
| 5,841,403 | A | | 11/1998 | West | |
| 5,870,066 | A | | 2/1999 | Asakura et al. | |
| 5,872,546 | A | | 2/1999 | Ihara et al. | |
| 5,903,240 | A | | 5/1999 | Kawahata et al. | |
| 5,966,098 | A | | 10/1999 | Qi et al. | |
| 5,973,651 | A | | 10/1999 | Suesada et al. | |
| 5,977,920 | A | | 11/1999 | Hung | |
| 5,990,838 | A | | 11/1999 | Burns et al. | 343/702 |
| 6,028,568 | A | | 2/2000 | Asakura et al. | |
| 6,031,505 | A | | 2/2000 | Qi et al. | 343/795 |
| 6,329,951 | B1 | * | 12/2001 | Wen et al. | 343/702 |
| 6,335,706 | B1 | * | 1/2002 | Elliot | 343/727 |
| 6,337,667 | B1 | | 1/2002 | Ayala et al. | |

FOREIGN PATENT DOCUMENTS

| | | |
|---|---|---|
| JP | 05347507 | 12/1993 |
| JP | 6204908 | 7/1994 |
| WO | 9638881 | 12/1996 |
| WO | 9733338 | 12/1997 |
| WO | 9812771 | 3/1998 |
| WO | 9903166 | 1/1999 |
| WO | 9925042 | 5/1999 |
| WO | 0001028 | 1/2000 |
| WO | 0178192 | 10/2001 |

* cited by examiner

ELECTRICALLY CONNECTED MULTI-FEED ANTENNA SYSTEM

CROSS-REFERENCE TO RELATED APPLICATION

This application is a continuation of U.S. application Ser. No. 09/543,176, filed Apr. 5, 2000 now U.S. Pat. No. 6,329,951.

FIELD OF THE INVENTION

The present invention relates to antennas that can send and receive signals from a radio frequency device. In particular the present invention relates to antennas that are used in portable hand held devices.

BACKGROUND OF THE INVENTION

An antenna is a transforming device that converts circuit currents into electromagnetic energy. Conversely, the antenna can convert electromagnetic energy into circuit currents. The frequency to which the antenna responds is based on characteristics of the antenna such as width and length. Changes in the width and length of the antenna affect the resistance of the antenna and shape the current densities along the length of the antenna. The antenna field can be affected by nearby objects, such as other antennas, which distort the performance of the antenna.

There remains a need for a portable hand-held communications device that implements an antenna in at least a transmitting or a receiving configuration. Ideally, the antenna conforms to the housing of the device and is positioned so that the antenna will transmit and receive regardless of the orientation of the device relative to the communications station.

SUMMARY OF THE INVENTION

An antenna system for a portable transceiver device comprises an antenna structure for transmitting and receiving RF signals. The antenna structure includes multiple feeding ports having a common structure fully coupling multiple antennas together. This antenna structure is made of a conductor that can be surface mounted over a nonplanar surface. When the conductor is mounted on a nonplanar surface, the antenna structure extends in three-dimensional space around the portable hand held communications device.

More accordingly, as a principal feature of the invention, an antenna system comprises an antenna structure, a first feeding port, and a second feeding port. The first and second feeding ports connect the antenna structure to communications circuitry. The antenna structure forms a first antenna structure connected to the first feeding port and further forms a second antenna structure connected to the second feeding port. Importantly, a portion of the first antenna structure is also a portion of the second antenna structure.

According to the present invention, there is also provided a portable communications device comprising: a transmitting circuit; a receiving circuit; and an antenna system, wherein the antenna system comprises a first antenna structure and a second antenna structure which has a common portion of a radiation element fully coupling the first antenna structure to the second antenna structure. Preferably, the first antenna structure and the second antenna structure include a monopole antenna, a dipole antenna, and a top loaded member wherein the top loaded member is a portion of the first antenna structure and the second antenna structure.

Preferred applications of the present invention include portable communication devices, wireless PDAs, and two-way paging devices.

Some of the advantages provided by the present invention include: high efficiency, high gain, wide bandwidth, and low SAR. In addition, the present invention allows for use of one piece of wire to realize two different antenna functions simultaneously. Further still, the present invention's use of two feeding points will allow optimization of the radio board layout to minimize EMI problems. Further and advantageously, there is no performance issue regarding coupling between antennas in the present invention as in traditional separate two antenna solutions wherein the coupling between the antennas degrades the antenna performance. Another advantage of the present invention is the simple layout. In the present invention a folded dipole is used as a transmitting antenna to raise the antenna radiation resistance thereby increasing efficiency. Traditional dipoles and monopoles that are widely used in wireless devices are very sensitive to a change in the environment. In contrast, the present invention is less sensitive to the environment by taking advantage of the environment by reducing the effects of the same. Further still, the present invention allows the potential for increasing bandwidth by appropriately changing wire lengths. Finally, the present invention allows for lower manufacturing cost due to simpler layout.

DESCRIPTION OF A PREFERRED EMBODIMENT

Figure 1:
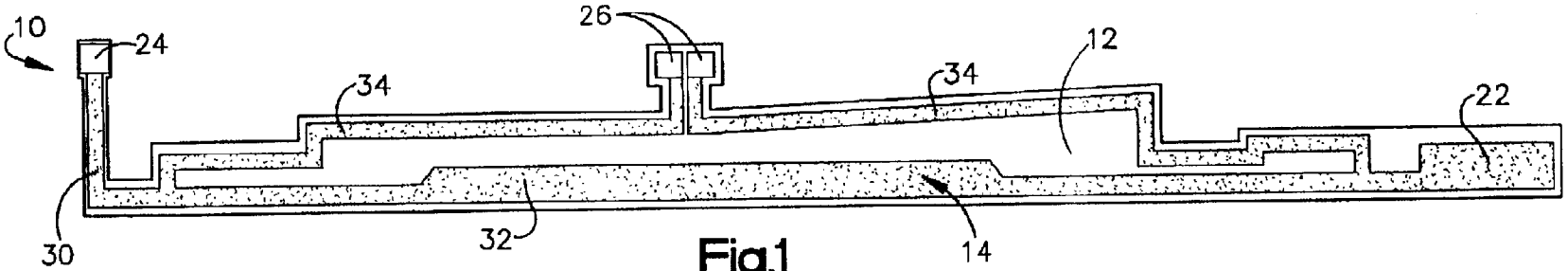
FIG. 1 is a top view of an antenna system comprising a preferred embodiment of the invention.

An antenna system 10 comprising a preferred embodiment of the present invention is shown in FIG. 1. The antenna system 10 comprises a backing substrate 12, and an antenna structure 14. The backing substrate 12 is made of a thin, flexible material. Preferably, the antenna structure 14 is made of a low resistance conductor and affixed to the backing substrate 12. In this manner, the antenna system 10 is a laminate with layers of the antenna structure 14 and the backing substrate 12.

The antenna structure 14 has distinct portions defining a radiating element, a top loading member 22, a monopole feeding port 24, and a dipole feeding port 26. The radiating element is a conductor that extends from the feeding ports 24 and 26 to the top loading member 22. Portions of the radiating element include: a monopole portion 30, a common portion 32, and a dipole portion 34. These portions 30–34 are configured so that the radiating member includes a first antenna structure 40 (as shown in FIG. 3) that functions as an effective monopole antenna and a second antenna structure 44 (as shown in FIG. 4) that functions as an effective dipole antenna.

Figure 3:
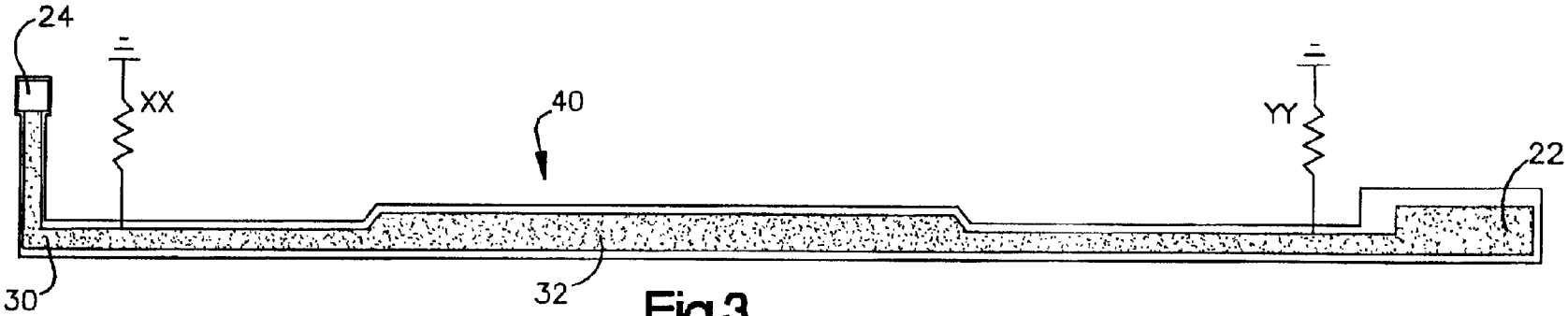
FIG. 3 is a partial view of the antenna system of FIG. 1.
Figure 4:
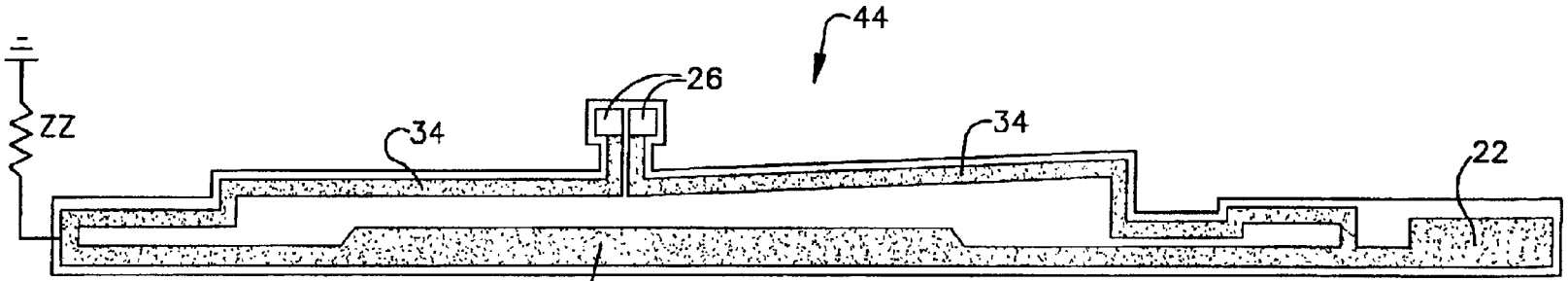
FIG. 4 also is a partial view of the antenna system of FIG. 1.

When the antenna system 10 is excited from the monopole feeding port 24, the dipole feeding port 26 and the dipole portion 34 of the antenna structure 14 are a load on the effective monopole antenna 40 (indicated as XX and YY on FIG. 3). When the system is excited from the dipole feeding port 26, the monopole feeding port 24 and the monopole portion 30 of the antenna structure 14 are a load on the effective dipole antenna 44 (indicated as ZZ on FIG. 4). The effective monopole antenna 40 includes a current path along the radiating element between the monopole feeding port 24 and the top loading member 22. As shown in FIG. 3, the primary path of the effective monopole antenna 40 is defined by the monopole portion 30, the common portion 32 and the top loading member 22. The loads XX and YY between the monopole feeding port 24 and the top loading member 22 have a high impedance, and consequently, very small amounts of current are delivered through the loads. The effective dipole antenna 44 includes a current path along the radiating element between the dipole feeding port 26 and the top loading member 22. As shown in FIG. 4, the path of the effective dipole antenna 44 comprises the dipole portion 30, the common portion 32, and the top loading member 22. The load ZZ between the dipole feeding port 26 and the top loading member 22 has a high impedance, and consequently, a very small amount of current is delivered through the load.

A dielectric housing 46 is a box-shaped container made of a dielectric material. The dielectric housing 46 has a top and bottom surface 52 and 54, a front and back surface 56 and 58, and opposite side surfaces 60 and 62. Within the dielectric housing 46 is a transmitting circuit 70 and a receiving circuit 74. The dielectric housing 46 holds the electronics of the transmitting circuit 70 and the receiving circuit 74.

Figure 2:
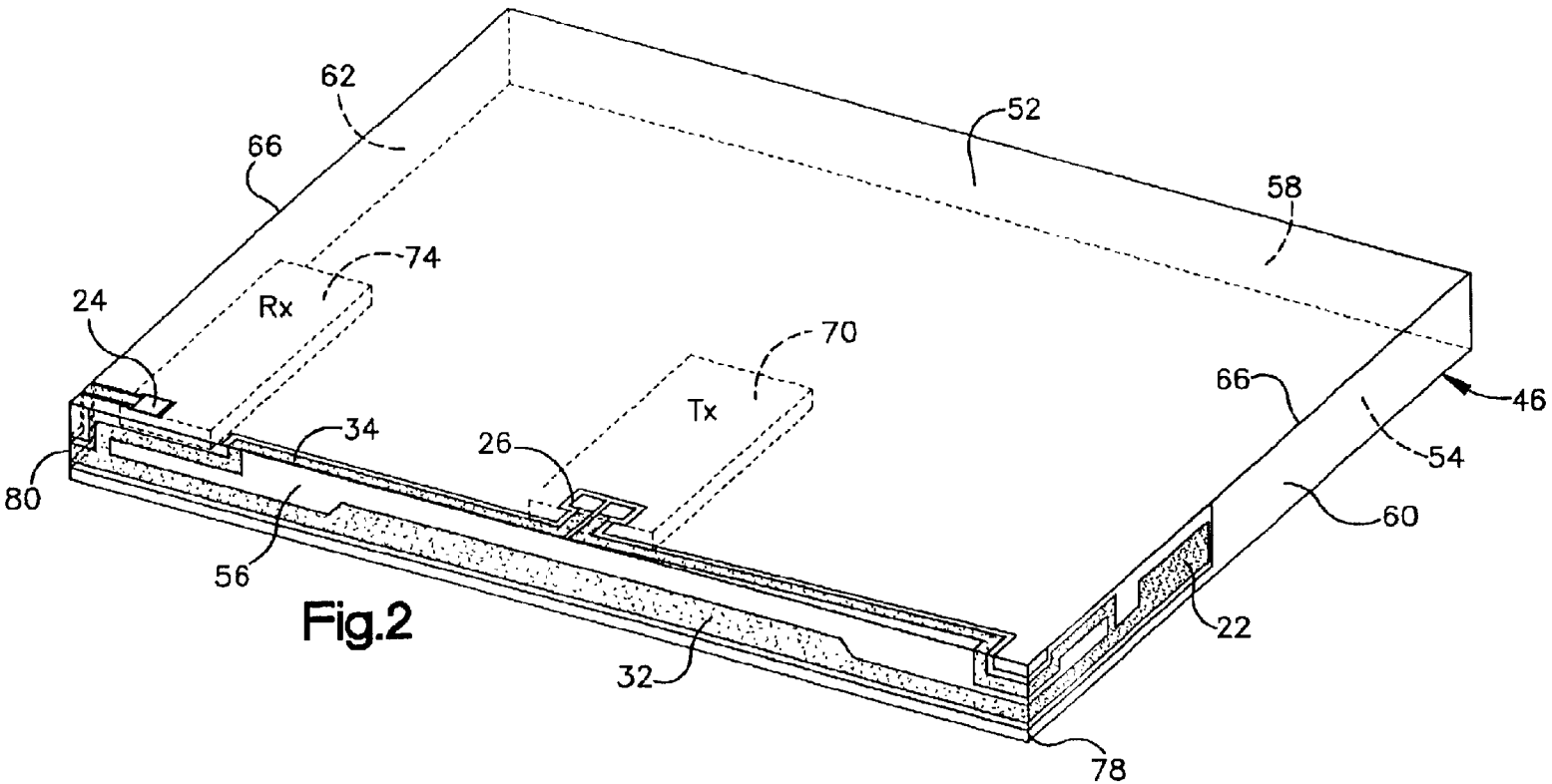
FIG. 2 is an orthogonal view of the antenna system of FIG. 1 mounted on a telecommunications device housing.

The antenna system 10 is folded from the original, flat configuration of FIG. 1 to the configuration in which it is mounted on the inside of the dielectric housing 46, as shown in FIG. 2. The antenna system 10 then extends around the dielectric housing 46 to orient the antenna structure 14 in multiple perpendicular planes. The top loading member 22 and the common portion 32 of the radiating element are mounted on the side surface 60. The common portion 32 and the dipole portion 34 of the radiating element extend around a front corner 78 from the side surface 60 to the front surface 56. The common portion 32 extends filly along the front surface 56 to the opposite corner 80. The dipole portion 34 turns upward from the front surface 56 to the top surface 52 and extends along the top surface 52. The dipole feeding port 26 also is located on the top surface 52 of the dielectric housing 46. Near the corner 80, the dipole portion 34 turns down from the top surface 52 back onto the front surface 56. The monopole portion 30 turns around the far front corner 80 from the front surface 56 to the far side surface 62 and again turns from the side surface 62 upward onto the top surface 52. The effective monopole antenna 40 and the effective dipole antenna 44 each extend in a plane parallel to the front surface 56, and planes parallel to the top surface 52, and the side surface 60. This orientation of the antenna system 10 makes the portable communications device 56 an omnidirectional transmit and receive device.

The monopole feeding port 24 is connected to the receiving circuit 74. The dipole feeding port 26 is connected to the transmitting circuit 70. Importantly, the current distributed from the monopole feeding port 24 mainly flows along the effective monopole antenna 40 while a small amount of current travels along the loads XX and YY. Since these loads are the high impedances of the dipole portion 34, dipole feeding port 26 and transmitting circuitry 70, the current distribution along the effective monopole antenna 40 is minimally changed. Similarly, when current is distributed from the dipole feed port 26, the current mainly flows along the effective dipole antenna 44 while a small amount of current travels along the load ZZ. Since the load ZZ is the high impedance of the monopole portion 30, monopole feeding port 24 and receiving circuit 74, the current distribution along the effective dipole antenna 44 is minimally changed. This configuration is important in the operation of the antenna system 10 in its transmit and receive states.

The effective monopole antenna 40 is sized to receive signals from a radio wave at a particular frequency by defining the length and width of its radiating element appropriately. Since the loads XX and YY have a high impedance, most of the current generated along the antenna structure 14 from the received radio signal is distributed along the effective monopole antenna 40. The length of the common portion 32 of the radiating element is sized so that the antenna is tuned to the chosen frequency for receiving signals.

The effective dipole antenna 44 is sized to transmit a signal at a specified frequency by defining the length and width of its radiating element appropriately. The high impedance of the load ZZ of the antenna structure 14 forces the current from the transmitting circuit 70 to flow along the effective dipole antenna 44. The length of the effective dipole antenna 44 is the length of both the common portion 32 and the dipole portion 34. The dipole portion 34 can thus be sized with the prior knowledge of the length of the common portion 32 to convert the circuit currents of the transmitting antenna to an electromagnetic signal at the desired frequency.

The top loading member 22 of the antenna structure 14 further alters the current distribution of each effective antenna 40 and 44. The top loading member thus further shapes the characteristics of each effective antenna 40 and 44 by adding perceived length to the antenna structure 14.

The invention has been described with reference to a preferred embodiment. Those skilled in the art will perceive improvements, changes, and modifications. Such improvements, changes, and modifications are intended to be within the scope of the claims.

We claim:

1. A multiple feed antenna system comprising:

a first antenna structure of a first antenna type having a first radiation element and coupled to a first feeding port that is configured to be coupled to communications circuitry; and a second antenna structure of a second antenna type coupled to a second feeding port that is configured to be coupled to communications circuitry, wherein the first antenna structure and the second antenna structure are electrically connected through a portion of the first radiation element so that the second antenna structure includes the portion of the first radiation element to form a second radiation element.

2. The antenna system of claim 1, wherein the first antenna structure and the second antenna structure include a monopole antenna.

3. The antenna system of claim 1, wherein the first antenna structure and the second antenna structure include a dipole antenna.

4. The antenna system of claim 1, wherein the first antenna structure and the second antenna structure comprise a top loaded member.

5. The antenna system of claim 4, wherein the top loaded member is a portion of the first antenna structure and the second antenna structure.

6. The antenna system of claim 1, wherein the first antenna structure and the second antenna structure comprise a transmitting antenna and a receiving antenna.

7. The antenna system of claim 1, further comprising a pair of feeding ports.

8. The antenna system of claim 7, wherein the feeding ports are connected to a radio circuit.

9. The antenna system of claim 1, wherein the first antenna structure and the second antenna structure are mounted on a mounting surface, the mounting surface extending in three dimensions so as to orient the first antenna structure and the second antenna structure in the three dimensions.

10. The antenna system of claim 9, wherein the mounting surface is a dielectric substrate.

11. The antenna system of claim 1, wherein the antenna system is operable in a portable communication device.

12. The antenna system of claim 1, wherein the antenna system is operable in a wireless PDA.

13. The antenna system of claim 1, wherein the antenna system is operable in a wireless paging device.

14. The antenna system of claim 1, wherein the antenna system is operable in a wireless two-way paging device.

15. A multiple feed antenna system, comprising:

a monopole antenna having a first radiation element and coupled to a first feeding port that is configured to be coupled to communications circuitry; and a dipole antenna coupled to a second feeding port that is configured to be coupled to communications circuitry, wherein the monopole antenna and the dipole antenna are electrically connected through a portion of the first radiation element so as to form a second radiation element.

* * * * *

UNITED STATES PATENT AND TRADEMARK OFFICE

CERTIFICATE OF CORRECTION

PATENT NO. : 6,781,548 B2
APPLICATION NO. : 10/014940
DATED : August 24, 2004
INVENTOR(S) : Wen et al.

It is certified that error appears in the above-identified patent and that said Letters Patent is hereby corrected as shown below:

Col. 6, line 14, insert the following:

16. The antenna system of claim 15, wherein the monopole antenna and the dipole antenna comprise a top loaded member.

17. The antenna system of claim 16, wherein the top loaded member is a portion of the monopole antenna and the dipole antenna.

18. The antenna system of claim 15, wherein the monopole antenna and the dipole antenna comprise a transmitting antenna and a receiving antenna.

19. The antenna system of claim 15, wherein the first and second feeding ports are connected to a radio circuit.

20. The antenna system of claim 15, wherein the monopole antenna and the dipole antenna are mounted on a mounting surface, the mounting surface extending in three dimensions so as to orient the monopole antenna and the dipole antenna in the three dimensions.

21. The antenna system of claim 20, wherein the mounting surface is a dielectric substrate.

22. The antenna system of claim 15, wherein the antenna system is operable in a portable communication device.

23. The antenna system of claim 15, wherein the antenna system is operable in a wireless PDA.

24. The antenna system of claim 15, wherein the antenna system is operable in a wireless paging device.

UNITED STATES PATENT AND TRADEMARK OFFICE

CERTIFICATE OF CORRECTION

PATENT NO. : 6,781,548 B2
APPLICATION NO. : 10/014940
DATED : August 24, 2004
INVENTOR(S) : Wen et al.

It is certified that error appears in the above-identified patent and that said Letters Patent is hereby corrected as shown below:

25. The antenna system of claim 15, wherein the antenna system is operable in a wireless two-way paging device.

Signed and Sealed this

Twenty-sixth Day of September, 2006

JON W. DUDAS
*Director of the United States Patent and Trademark Office*